United States Patent [19]

Gunn

[11] 4,253,503

[45] Mar. 3, 1981

[54] MANIFOLD FUEL VAPOR WITHDRAWAL SYSTEM

[75] Inventor: Kenneth M. Gunn, Glenham, N.Y.

[73] Assignee: Texaco Inc., White Plains, N.Y.

[21] Appl. No.: 50,567

[22] Filed: Jun. 21, 1979

[51] Int. Cl.[3] ..... B65B 31/04

[52] U.S. Cl. ..... 141/59; 141/301

[58] Field of Search ..... 141/37-64, 141/1-8, 285-310, 351-362, 382-386, 192-229, 392; 137/85, 100, 269; 251/282, 61.4; 220/85 VR, 85 VS; 403/50, 51; 222/318

[56] References Cited

U.S. PATENT DOCUMENTS 3,874,427 4/1975 Tiggelbeck ..... 141/290

4,057,085 11/1977 Shihabi ..... 141/290

4,057,086 11/1977 Healy ..... 141/206

*Primary Examiner*—Houston S. Bell, Jr.

*Attorney, Agent, or Firm*—Carl G. Ries; Robert A. Kulason; Robert B. Burns

[57] ABSTRACT

System for transferring a volatile liquid fuel from a common source, into one or more of a plurality of dispensing nozzles. The latter can be individually or simultaneously operated to service one or more vehicles. The system avoids passage of fuel vapors into the atmosphere during the transfer operation by providing a preferential path back into the fuel tank or other vapor storage devices through a central, vacuum controlled assist apparatus.

11 Claims, 4 Drawing Figures

LIQUID
VAPOR

MANIFOLD FUEL VAPOR WITHDRAWAL SYSTEM

BACKGROUND OF THE INVENTION

During the transfer of a volatile liquid such as gasoline or a similar fuel from a storage facility, there may be an unsealed connection made between the disconnectable nozzle and the tank being filled. As the transfer operation progresses, residual gases as well as air contained in the tank, sometimes are displaced into the atmosphere.

Many municipalities and governmental agencies have proposed or adopted regulations intended to reduce or at least control these emissions. One method toward complying with mandated regulations is the provision of a substantially, or completely closed system between the fuel source or storage facility and the tank or tanks being filled.

Such a closed system normally includes individual conduits which carry the vaporizable fuel. The remote end of each conduit is provided with a manually operated dispensing nozzle. The nozzles are adapted to be removably positioned within the filler pipe of a receiving tank. Further, they include means to form a partially sealed engagement between the nozzle spout and the tank filler tube.

Also, in some instances, the fuel carrying system is not fully closed, but rather is controllably vented to the atmosphere. With such an arrangement, as liquid is pumped from the source, either of two eventualities could occur. If fuel leaving the storage tank or source is not immediately replaced by vapor from the tank being filled, air will be drawn into the system. On the other hand, when excessive vapors are withdrawn from the tank being filled, some vapors will have to be vented to avoid a pressure build-up.

Several embodiments of sealing arrangements have been found to be advantageous for providing the necessary partial or substantially vapor tight, yet disconnectable engagement at the nozzle spout. One method for providing the desired engagement, is to attach a cylindrical, flexible walled member such as a rubber boot or the like, to each fuel dispensing nozzle.

The boot, when properly positioned, will substantially surround the nozzle spout when the latter is registered in place. By use of such an arrangement, when a nozzle is registered in a filler pipe of the receiving tank, the walls of the flexible boot will be deflected and/or distorted. The boot will thereby define an annular vapor tight, or substantially vapor tight passage.

This type of arrangement has generally been found to be highly effective. Thus, when a fuel flow is introduced from a nozzle into a particular receiving tank, a slight pressure is produced within the tank to displace a mixture of air and fuel vapors. These displaced vapors will be urged upwardly through the annulus defined by the nozzle spout and the flexible member. Said vapors can then be transferred by way of the dispensing nozzle through a separate conduit to the fuel source, or to another reservoir for retaining the vapors.

The effectiveness of this system depends to a large degree on the mechanical compotibility of the vehicle fuel tank with the nozzle to permit a satisfactory mating relationship at their interface. If for any reason the contact edge of the nozzle boot does not engage the filler pipe, an imperfect seal arrangement is achieved and some vapor leakage can occur.

In conjunction with closed fuel systems, vacuum assist means have been devised which cause the vapor collection system to operate under a slight vacuum. Operationally, the vacuum system will function to establish a reduced pressure at the nozzle-tank filler pipe juncture to collect the displaced vapor by aspiration.

In the presently disclosed arrangement, a system is provided which incorporates a number of features which include: (1) provision for compensating for an imperfect seal at the vehicle tank-nozzle interface, (2) a vacuum assist means adapted to aid in withdrawing and collecting vapors from those vehicles being serviced, and (3) a common blower or vapor inductor system which is manifolded to a plurality of fuel dispensing units, which system will stabilize the vacuum condition at each nozzle regardless of how many of the latter are in operation at any one time.

The instant system thus provides a fuel dispensing or vehicle service facility which embodies a plurality of pumps or fuel filling units. A vapor return segment is incorporated into the fuel dispensing segment of the system.

Functionally, as a fuel transfer operation at any one or more of the several dispensers commences, a blower in the vapor segment is concurrently actuated. Fuel passing through the dispensing facility further actuates a proportioning valve which in turn regulates the vapor flow from that particular dispenser. Thereafter, the system's main blower will continuously operate to collect vapors and direct them to storage so long as any one or more of the individual proportioning valves is operable to communicate one or more of the dispensers with the vapor withdrawal system.

Toward assuring the operation of the overall system under varying circumstances, a vapor blower is provided having a capacity greatly in excess of the volume of vapor to be removed. A valved bypass conduit is provided across the vapor blower or inductor to recirculate vapors from blower discharge back through the blower's suction side. This arrangement maintains a substantially constant vacuum condition in the system, regardless of the vapor flow rate.

An object of the invention therefore is to provide a fuel system for a multi-station fuel dispensing facility, which system embodies a dispensing nozzle adapted to removably engage a fuel receiving tank. A further object is to provide a vapor collecting system of the type contemplated which is actuated in response to the inflow of fuel to the receiving tank. A still further object is to provide a vacuum assist arrangement within a fuel system having a plurality of dispensing nozzles, which vacuum assist is adjusted in response to the flow of fuel into a tank, and which is stabilized to each of the nozzles, regardless of the number of nozzles in operation.

DESCRIPTION OF THE DRAWINGS

In the drawings,

Referring to FIG. 1, the drawings illustrate an installation of the type contemplated, preferably a service or refueling station for vehicles, boats, etc., wherein the present vacuum assist arrangement is incorporated. The installation as shown includes primarily a reservoir or storage tank 10 which is normally buried beneath the ground. A venting means 11 extends from the upper end of the storage tank. This feature permits passage of vapors into the atmosphere at such times as the pressure within tank 10 exceeds a predetermined desired level.

Figures 1, 2:
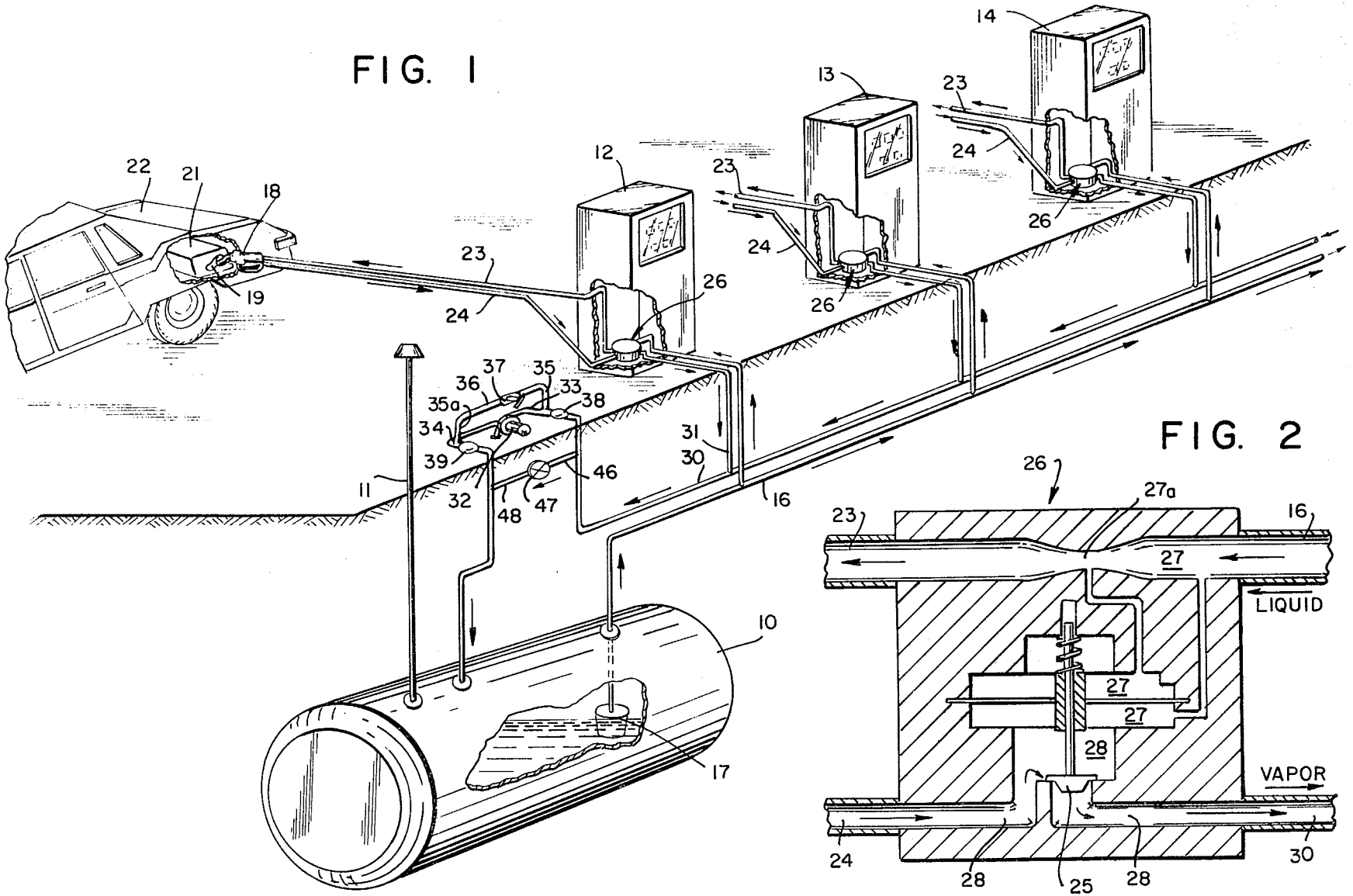
FIG. 1 represents an environmental arrangement of the presently disclosed closed fuel system which is capable of connecting an underground storage tank with one or more receiving tanks to be filled.
FIG. 2 is similar to FIG. 1, illustrating parts of the integrated fuel and vapor segments schematically to show internal working parts thereof.

In accordance with the general arrangement of most automotive filling stations the installation is provided with a series of terminal stations 12, 13 and 14. Frequently each station will dispense a different grade of fuel. In the arrangement shown however, all the stations handle the same fuel. Normally, a vehicle can temporarily park adjacent to one of said stations to receive a transfer of fuel.

Each terminal station is supplied from a principal liquid fuel carrying manifold 16. Said manifold 16 is in turn communicated with a reservoir or with storage tank 10 by way of pump 17. Operationally, although not shown in detail, a metering means at each terminal station is actuated to measure the fuel flow.

Each terminal station, 12 for example, further includes a dispensing nozzle 18 which is manually operable to regulate the fuel flow therethrough. To function in the instant system, dispensing nozzle 18 is adapted to be registered within the filler pipe 19 of a receiving tank 21, of a vehicle 22.

Nozzle 18 is provided with means for establishing the necessary removable engagement, preferably a close relationship with tank 21. Engagement is initiated by inserting nozzle 18 into the receiving tank filler pipe 19 a sufficient distance to form a substantially vapor tight seal between the filler pipe lip, and a deformable member depending from the nozzle.

Sealable nozzles of this type are well known in the art, and a number of embodiments have been widely used to establish the desired close, or substantially vapor tight relationship with a receiving tank.

Further, and as mentioned, although not instantly shown, each terminal station such as 12 usually includes a means by which fuel flow can be manually initiated at the dispensing nozzle 18. Switching means is also provided at each terminal station, and is manually actuated by an operator upon removal of nozzle 18. This latter feature is not shown specifically since it also is a concept well known in the art and long used in service stations of the type contemplated.

To remove vapors, including both fuel and air from a receiving tank 21 during a fuel transfer operation, nozzle 18 is provided with internal valved passages for carrying liquid fuel. The nozzle is further provided with discrete passages for removing vapors which are displaced from tank 21. Said vapors when withdrawn, are introduced to a vapor return line 24 and conducted back to terminal station 12.

At terminal station 12, a proportioning valve 26 is provided comprising separate liquid and vapor compartments 27 and 28. Liquid compartment 27 as shown, is communicated with the fuel inlet manifold 16 and with fuel carrying conduit 23. Thus, fuel flow through constriction 27*a* of compartment 27 serves to adjust flow regulating means in the vapor compartment 28 whereby to alter the flow through the latter by way of valve 25. As liquid fuel is flowing through compartment 27, the valve 25 will thus be adjusted to regulate the vapor flow.

During a liquid fuel transfer operation at any of terminal stations 12, 13 or 14, when vapor is drawn through the vapor chamber 28, it will enter vapor discharge line 31. Vapor from each of the respective proportioning valves 26 will consequently enter a common vapor manifold 30. Said manifold is communicated in turn with a vapor inductor 32.

Figure 3:
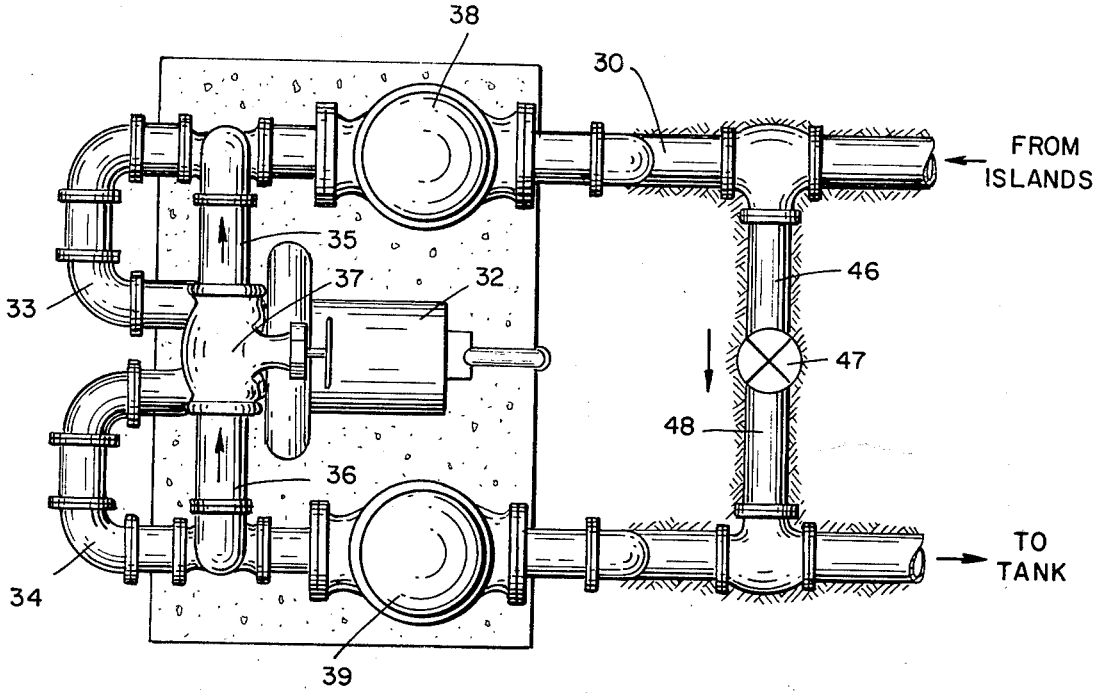
FIGS. 3 and 4 represent the liquid bypass system.
Figure 4:
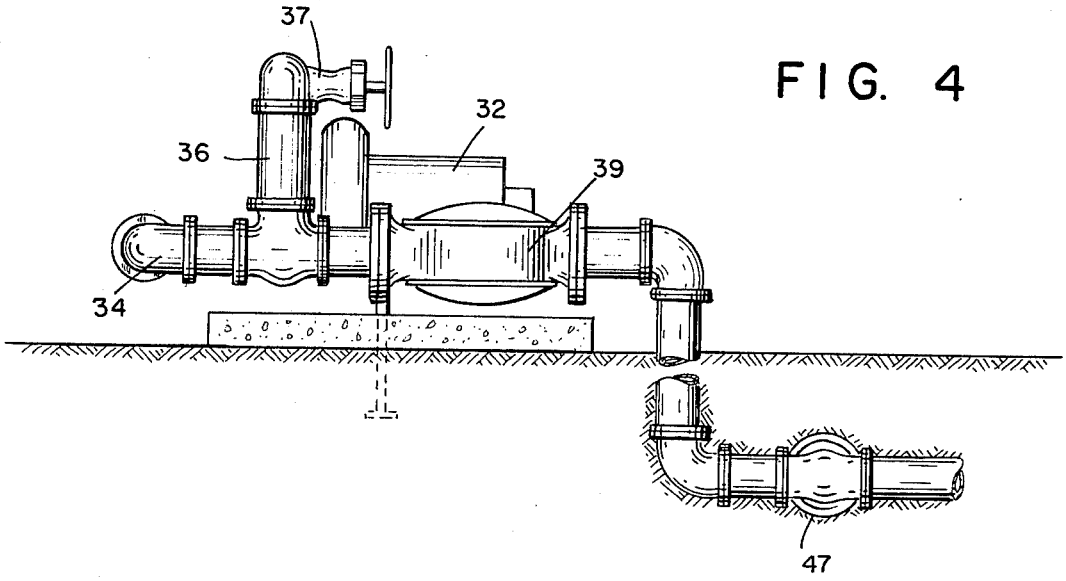

The vapor inductor apparatus as shown schematically in FIG. 3 and in FIG. 4, includes in one embodiment a motor driven member 32 such as a fan, impeller, or the like. Said inductor 32 includes an inlet 33 communicated with vapor carrying manifold 30. The inductor discharge port 34 is communicated with reservoir 10 to deposit a flow of withdrawn vapors into the latter.

The return vapor as shown is deposited into reservoir 10 from which liquid fuel was initially drawn. It is understood, however, that said vapor can likewise be deposited in a suitable alternate receptacle or reservoir. Such alternative will depend on the capability of the facility for receiving and storing the vapors.

Vapor inductor 32 further includes a valved bypass disposed to communicate the inductor inlet port 33 with the outlet port 34. Said valved bypass includes valve means 37 which is operable to regulate the passage of vapor through inductor 32 and the bypass. Valve 37 is communicated with inlet 33 by way of line 35, and with outlet 34 by way of line 36. Valve 37 is normally preset to afford a desired rate of vapor recirculated through inductor 32. Said flow is preferably far in excess of the amount of vapor which is to be withdrawn collectively from the respective stations. Recirculated flow through inductor 32 can thus be 5 to 10 times the maximum flow which is expected to be taken from station 12.

As a safety measure the vapor inductor 32 can be provided with flame arresting means 38 and 39 disposed upstream and/or downstream thereof to prevent propagation of flame as a result of any inadvertent ignition of vapors which pass through the inductor circuit 32.

Subsequent to leaving valve 26, fuel vapors, under particular circumstances, could condense in conduit 30. Said conduit is therefore, preferably not only buried, but is placed at a predetermined slope to promote drain of any condensate therein back to the storage tank 10.

To avoid entry of condensate into the inductor circuit, the underground return line is provided with a liquid bypass. Said bypass includes a first line 46 which communicates with the lowest end of conduit 31. Said line 46 thus passes condensate into check valve 47 which in turn communicates with tank 10 by way of line 48.

Operationally, the instant vacuum assist system is capable of servicing a single vehicle, or a multiplicity of vehicles simultaneously from the respective terminal stations 12, 13 and 14. However, to maintain a desirable degree of vacuum assist at each of the terminal stations, and consequently at the respective dispensing nozzles 18, proportioning valves 26 operate individually. Each of said valves provides the desired degree of vapor flow control, which, together with the vapor flow through the blower loop, regulate and stabilize the degree of vacuum at each nozzle.

For example, in the instance when a single vehicle is being refueled, as the fuel pump 17 is actuated by an operator to initiate liquid flow, proportioning valve 26 remains in the closed position. However, at such time as dispensing nozzle 18 is registered to filler pipe 19, actuation of the nozzle's control lever initiates a flow of fuel through proportioning valve 26. Liquid will flow through compartment 27. This will in turn cause the valves in compartment 28 to open a proportional amount and thereby permit vapor to be drawn through said chamber 28 and into the vapor return manifold 30.

When a plurality of vehicles are being simultaneously serviced the respective proportioning valves 26 will be individually actuated to open the respective vapor compartments. Thus, each of the proportioning valves will permit a comparable degree of flow in the vapor return line since the vapor inductor circuit maintains a relatively uniform degree of vacuum at each nozzle 18.

Actuation of the vapor inductor circuit can be achieved in response to the initial actuation of any of the individual fuel flow control valves. In any event vapor will be continuously circulated through inductor 32 and the bypass segment. Thus, vapor will be passed from the inductor to tank 10 only as said vapor is received from one or more of the pumping stations.

Other modifications and variations of the invention as hereinbefore set forth can be made without departing from the spirit and scope thereof, and therefore, only such limitations should be imposed as are indicated in the appended claims.

I claim:

1. In a volatile liquid carrying system which is adapted to conduct streams of a volatile liquid from a reservoir (10) thereof to a plurality of pumping stations (12), each of the latter being adapted to communicate with a receiving tank (21), and during a tank filling operation to concurrently pass vapors displaced from the respective receiving tanks being filled, to a vapor storage facility, said system including;

conduit means (24) detachably engageable at one end thereof (18) with one or more of a plurality of said receiving tanks (21) to collect vapors which are displaced from the latter concurrent with the entry of liquid thereto, a common manifold (30) communicating the respective conduit means (24) with said vapor storage facility, a vacuum assist circuit interposed in said common manifold means (30), and including a vapor inductor (32) having an inlet (33) communicated with manifold (30), and an outlet (34) communicated with said storge facility, valved bypass means (37) communicating said vapor outlet port (34) with inlet port (33) to continuously circulate a quantity of vapor through the inductor (32) during a fuel transfer operation to any one or more of said receiving tanks (21), whereby to establish the substantially constant vacuum condition within said common manifold (30) regardless of the number of pumping stations which are operating.

2. In an apparatus as defined in claim 1, including;

valve means (26) communicated with the liquid carrying segment of said system and said vacuum assist circuit respectively, and being operable to regulate the flow of vapor through said manifold (30).

3. In an apparatus as defined in claim 1, wherein said valve means (26) includes;

a first vapor valve section (27) in said liquid carrying segment, and a second valve means (28) in said vapor carrying segment, said second valve means being operable in response to liquid flow passing through said first valve.

4. In an apparatus as defined in claim 3, wherein said first valve section includes means to be preset to permit a predetermined liquid flow through the valve section.

5. In an apparatus as defined in claim 3, wherein said second valve means is connected in said vapor circuit at a point upstream of said common manifold (30) to regulate the flow of vapors passing to the latter in response to the flow of liquid passing through said first valve section (27).

6. In an apparatus as defined in claim 3, wherein said second valve means is connected at a point intermediate the receiving tank (21) and said common manifold (30) to regulate the flow of vapor passing to the latter.

7. In an apparatus as defined in claim 1, including; check valved means (37) in said valve vapor bypass member being adapted to allow unidirectional vapor flow through said bypass.

8. In an apparatus as defined in claim 1, wherein said vapor carrying circuit includes; a liquid trap communicated therewith to prevent entry of liquid into said vapor inductor (32).

9. In an apparatus as defined in claim 8, wherein said liquid trap includes; a check valve (47) disposed therein to permit unidirectional flow of liquid therethrough.

10. In an apparatus as defined in claim 8, wherein said liquid trap includes; conduit means (46, 48) communicating said common manifold (30) with said vapor storage facility (10).

11. In an apparatus as defined in claim 8, wherein said liquid trap includes; a conduit means (46, 48) fixedly positioned at a slope and continuous with said common manifold (30) to permit downward flow of liquid toward said storage facility (10).

* * * * *